US012215945B2

(12) United States Patent
Bozó

(10) Patent No.: US 12,215,945 B2
(45) Date of Patent: Feb. 4, 2025

(54) DOUBLE FIRING MODE SEMI-AUTOMATIC HANDGUN

(71) Applicant: GESTAMEN KUTATÁS FEJLESZTÉS ZRT., Csongrád (HU)

(72) Inventor: Gábor Bozó, Csongrád (HU)

( * ) Notice: Subject to any disclaimer, the term of this patent is extended or adjusted under 35 U.S.C. 154(b) by 0 days.

(21) Appl. No.: 18/282,478

(22) PCT Filed: Feb. 25, 2022

(86) PCT No.: PCT/HU2022/050017

§ 371 (c)(1),
(2) Date: Sep. 15, 2023

(87) PCT Pub. No.: WO2022/195309

PCT Pub. Date: Sep. 22, 2022

(65) Prior Publication Data

US 2024/0142188 A1 May 2, 2024

(30) Foreign Application Priority Data

Mar. 17, 2021 (HU) ..... P2100110

(51) Int. Cl.
*F41A 19/13* (2006.01)
*F41A 19/14* (2006.01)
*F41A 19/16* (2006.01)

(52) U.S. Cl.
CPC ..... *F41A 19/16* (2013.01); *F41A 19/13* (2013.01); *F41A 19/14* (2013.01)

(58) Field of Classification Search
CPC ..... F41A 19/16; F41A 19/13; F41A 19/14; F41A 19/06; F41A 11/02; F41A 19/15; F41A 19/30; F41A 19/43; E05Y 2201/26; E05Y 2800/678; E05Y 2900/154; E05D 1/06; E05D 11/06; E05D 11/082; E05D 1/04; E05F 5/00; F41C 3/00
USPC ..... 89/155, 156, 184; 42/26, 69.01, 69.02, 42/38, 39, 2, 69.03, 70.08
See application file for complete search history.

(56) References Cited

U.S. PATENT DOCUMENTS 2,451,527 A * 10/1948 Albree ..... F41A 19/25 89/197
4,058,922 A * 11/1977 Elbe ..... F41A 11/02 42/16
6,257,116 B1 * 7/2001 Moczijdlower ..... F41A 21/488 89/184
2001/0022131 A1 * 9/2001 Moczijdlower ..... F41A 5/34 89/155
2016/0320155 A1 * 11/2016 Singh ..... F41A 17/72
2017/0268843 A1 * 9/2017 Heizer ..... F41A 19/45
(Continued)

*Primary Examiner* — Michael D David

(57) ABSTRACT

A double firing mode semi-automatic handgun has a frame, a barrel, a spring biased slide, and a firing assembly with a firing rod operated by a trigger. A frame pocket is provided in a rear part of the frame which is open from above, in which an associated frame inset or an associated other frame inset can be inserted. A rear part of the slide has a slide pocket in which an associated slide inset or an associated other slide inset can be inserted. A firing pin is arranged in front of the connection site of the frame pocket and behind the barrel extending to a cartridge receiving chamber. A rearward motion of the firing rod causes a surface to be pushed on the frame inset and transforms into an axial hit on the firing pin by a spring bias or by the release of a lock.

5 Claims, 6 Drawing Sheets

(56) References Cited

U.S. PATENT DOCUMENTS

| | | | | |
|---|---|---|---|---|
| 2018/0058788 | A1* | 3/2018 | Singh | F41A 17/70 |
| 2018/0087860 | A1* | 3/2018 | Sullivan | F41A 19/12 |
| 2019/0186857 | A1* | 6/2019 | Galie | F41A 19/10 |
| 2020/0056853 | A1* | 2/2020 | Singh | F41A 19/12 |
| 2021/0247159 | A1* | 8/2021 | Galie | F41A 19/16 |
| 2022/0214127 | A1* | 7/2022 | French | F41A 19/16 |

* cited by examiner

DOUBLE FIRING MODE SEMI-AUTOMATIC HANDGUN

The invention relates to a double firing mode semi-automatic handgun, comprising a frame, a barrel, a spring biased slide, and a firing assembly with a firing rod operated by the trigger.

Handguns have several types and operating systems, of which those using a rotatable cylinder are called as revolver, and which have a detachable magazine that can be inserted in a chamber in the frame are often called as pistols. Based on the way how firing takes place there are also several systems, of which the most frequently used are the hammer system and the striker system.

A typical example for the hammer firing system is the Colt 1911 or in other name M 1911 pistol, which is also described in detail in Wikipedia. The downward turning of the hammer arranged at the rear part of the frame biases a spring and the hammer gets into cocked position, and the pulling of the trigger releases the locking and the hammer turn with high speed into upward position and its front part hits the rear face of the slide which trusts the firing pin forward that hits the primer of the cartridge.

A typical type of striker system pistols is constituted by the Glock 17 model also described in Wikipedia. In this model a spring-biased hitting pin is arranged in the interior of the slide which gets locked when the slide is pull back, and when the trigger is pulled, the locking gets released, the pin is pushed forward by the biased spring, and this hits the primer of the cartridge triggering the shot.

The listed systems are all provide semi-automatic operation.

Both systems are liked by respective large groups of users because of their preferred properties, whereas conventional pistols can fire only in one of these two modes.

There is a need for providing a handgun that can fire in both of these modes, wherein the changing from one mode to the other can be carried out easily and quickly and wherein the costs associated with the double mode are hardly higher than the cost of a handgun with single firing mode.

The task of the invention is to provide a semi-automatic handgun which can be used alternatively to either hammer or striker firing modes.

For solving this task a double firing system semi-automatic handgun has been provided that comprises a frame, a barrel, a spring-biased slide, and a firing assembly with a firing rod operated by the trigger, wherein according to the invention the handgun comprises a frame pocket provided in the rear part of the frame that is open from above, in which in hammer system an associated frame inset and in striker system an associated other frame inset can be inserted, and the rear part of the slide comprises a slide pocket in which in hammer system an associated slide inset and in striker system slide inset an associated other slide inset can be inserted, and in front of the connection site of the slide pocket and behind the barrel a firing pin is arranged extending to a cartridge receiving chamber, and in both firing modes the frame inserts and the slide inserts cooperate and by means of the rearward motion of the firing rod a surface is pushed on the frame inset, namely in hammer mode a surface of a releasing bolt and in striker mode a buffer face, and this pushing movement is transformed into an axial hit on the firing pin by a spring bias or by the release of a lock.

In hammer firing mode in the rear part of the frame inset a hinge is provided around which a pulling hammer can be turned, and locked biasing elements and a locking mechanism are coupled to the pulling hammer that can be released by a releasing bolt, and a bore extends through the slide inset in which a pin is guided for limited axial movement that has a rear end extending out from a rear face of the slide inset which is hit by the upper face of the pulling hammer when the locking gets released, and then the other end of the pin extends out of the front of the slide inset and hits and pushes the rear end face of the firing pin.

In striker mode in the other frame inset a locking nose is provided that extends out till the bottom of the other slide inset, and the locking nose is connected with the buffer face by means of a hinged multi-lever assembly that is moved in downward direction when the buffer face is pushed backwards, and in the other slide inset a stepped axial bore is provided in which a striking pin is guided, at the front part of the stepped bore an abutment member is provided which abuts the forward end of a spring surrounding the striking pin, and the striking pin has a frontal shoulder which supports the abutment member, and in the rear part of the stepped bore a sleeve is arranged, and the spring contacts the front end of the sleeve, and around the rear end part of the striking pin an upper part of a locking fork is arranged, and between a front face of the locking fork and a shoulder of the sleeve a second spring weaker than said spring is arranged, and when the slide moves following a rearward movement in forward direction the locking fork gets locked by the locking nose arranged in the frame inset, whereby the spring gets biased in this locked position.

In a preferred embodiment the frame inset comprises at its upper part lateral swelling parts and in the frame pocket opposite to the swelling parts conforming cavities are arranged in which the swelling parts can be fitted.

It is preferred if in the central upper zone of the slide insets an upwardly extending part is provided comprising a transversal bore, and the slide comprises a corresponding opening and a transversal bore by which the slide inset can be fixed in the slide.

The handgun according to the invention is associated therefore with two frame insets and two slide insets of whom always the pair should be inserted in the frame and in the slide which corresponds to the actually required mode of firing.

The invention will now be described in connection with a preferable embodiment thereof in which reference will be made to the accompanying drawings. In the drawings.

Figure 12:
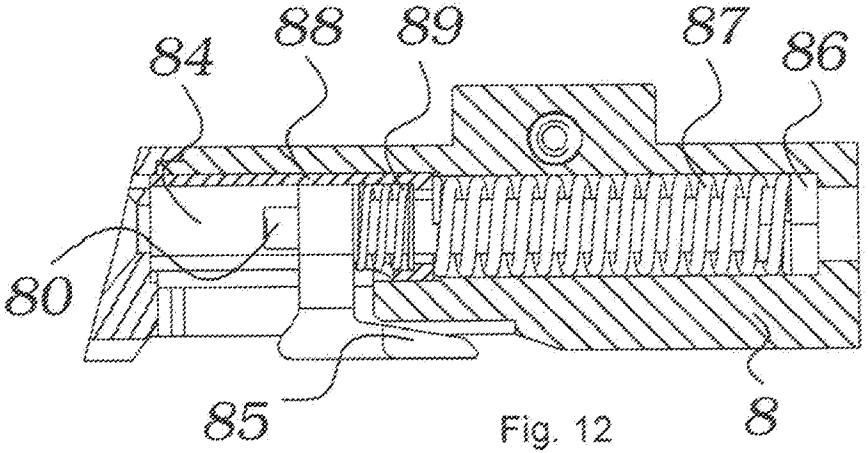
Figure 11:
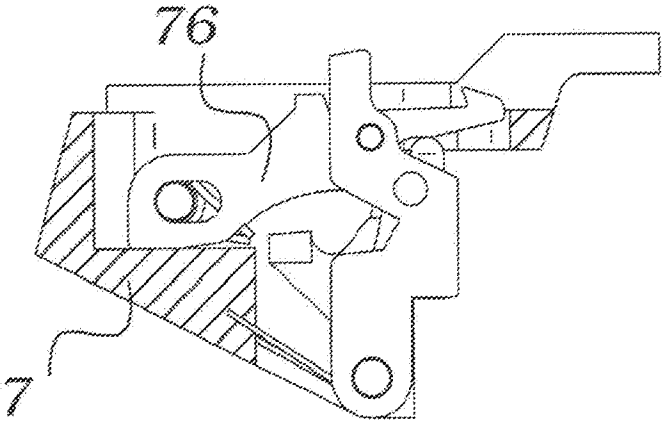
Figure 10:
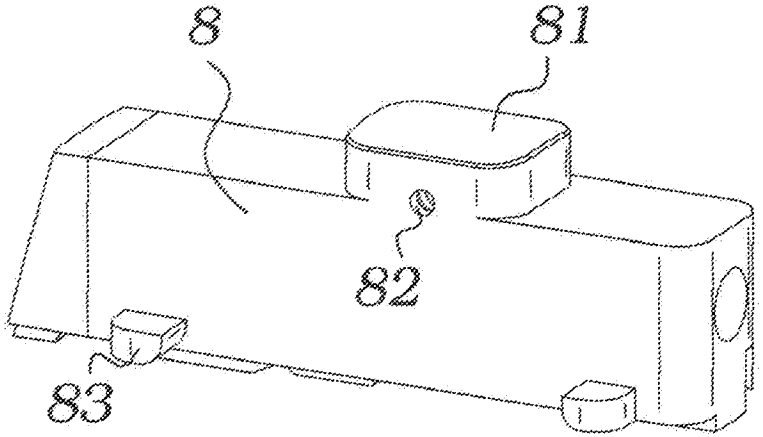
Figure 9:
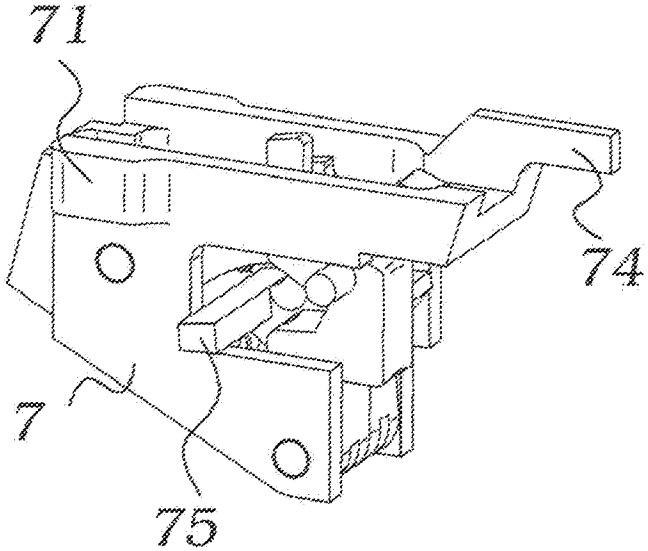

FIG. 9 sows the perspective view of the frame inset in striker system;

FIG. 10 shows the perspective view of the slide inset in striker system;

FIG. 11 is a view similar to FIG. 9 sowing the frame inset in sectional view;

FIG. 12 is similar to FIG. 10 showing the slide inset in section; and

Figure 8:
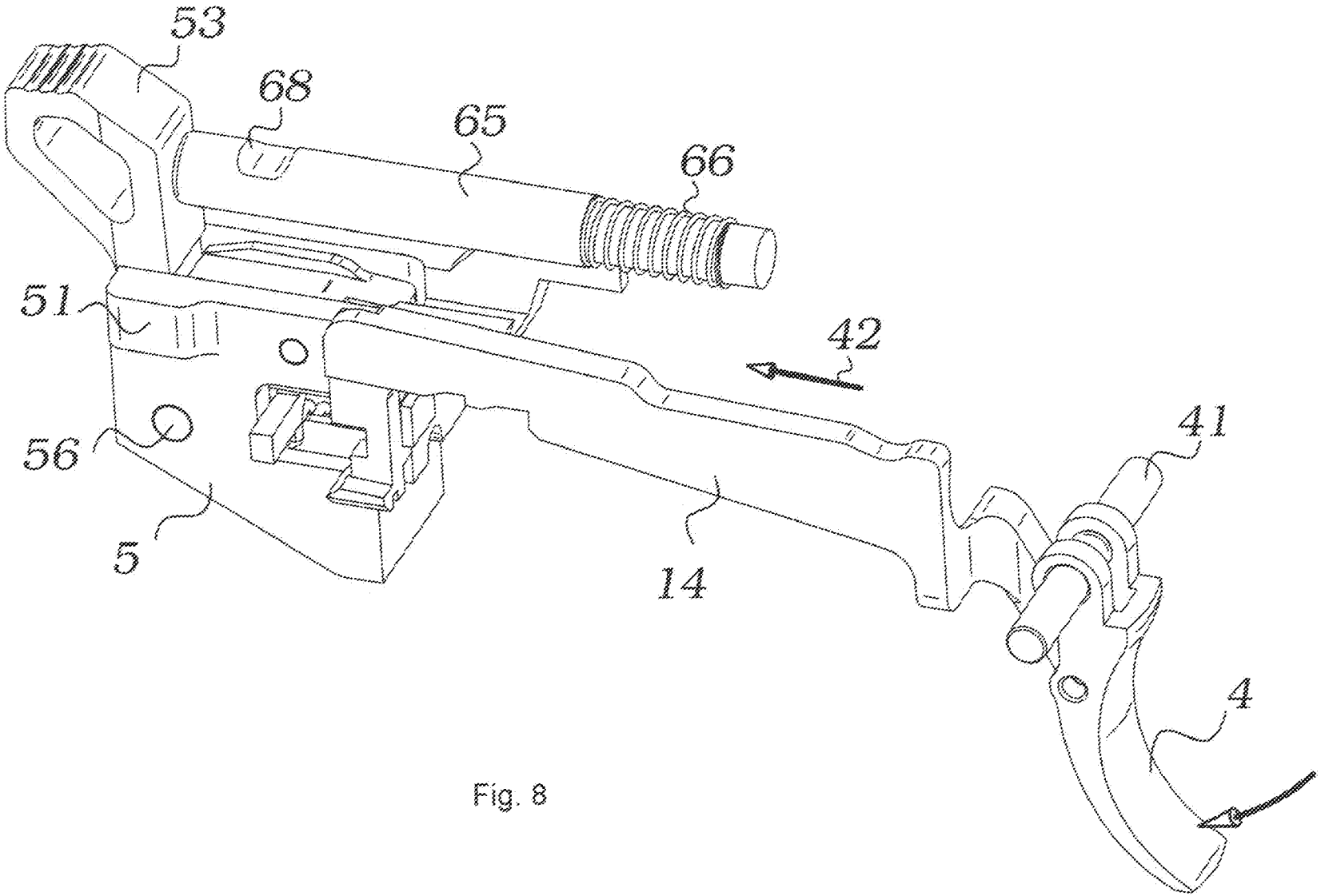
FIG. 8 shows the perspective view of a detail of the firing assembly in hammer system.
Figure 13:
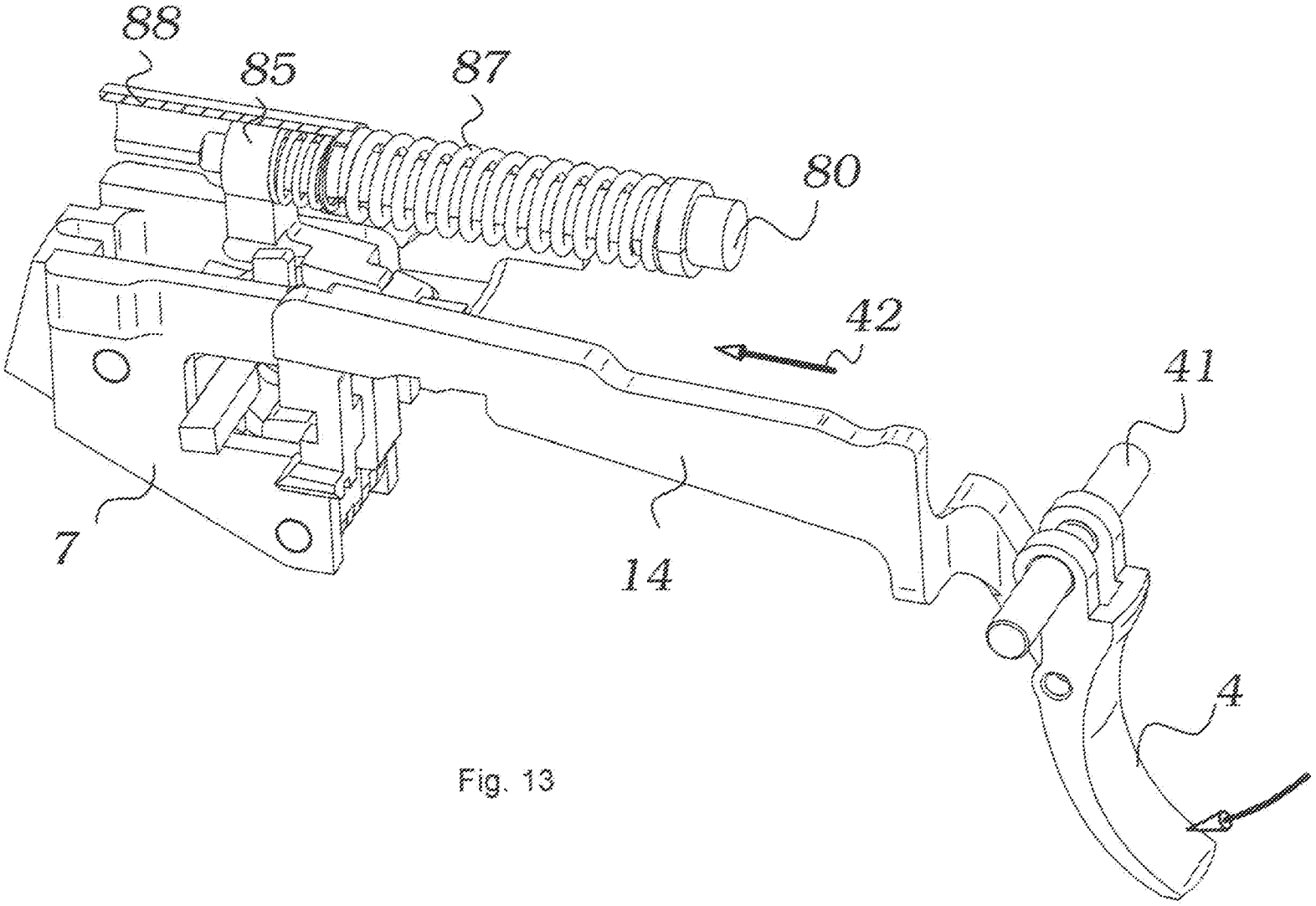

FIG. 13 is a view similar to FIG. 8 showing the arrangement in striker system.

Figure 1:
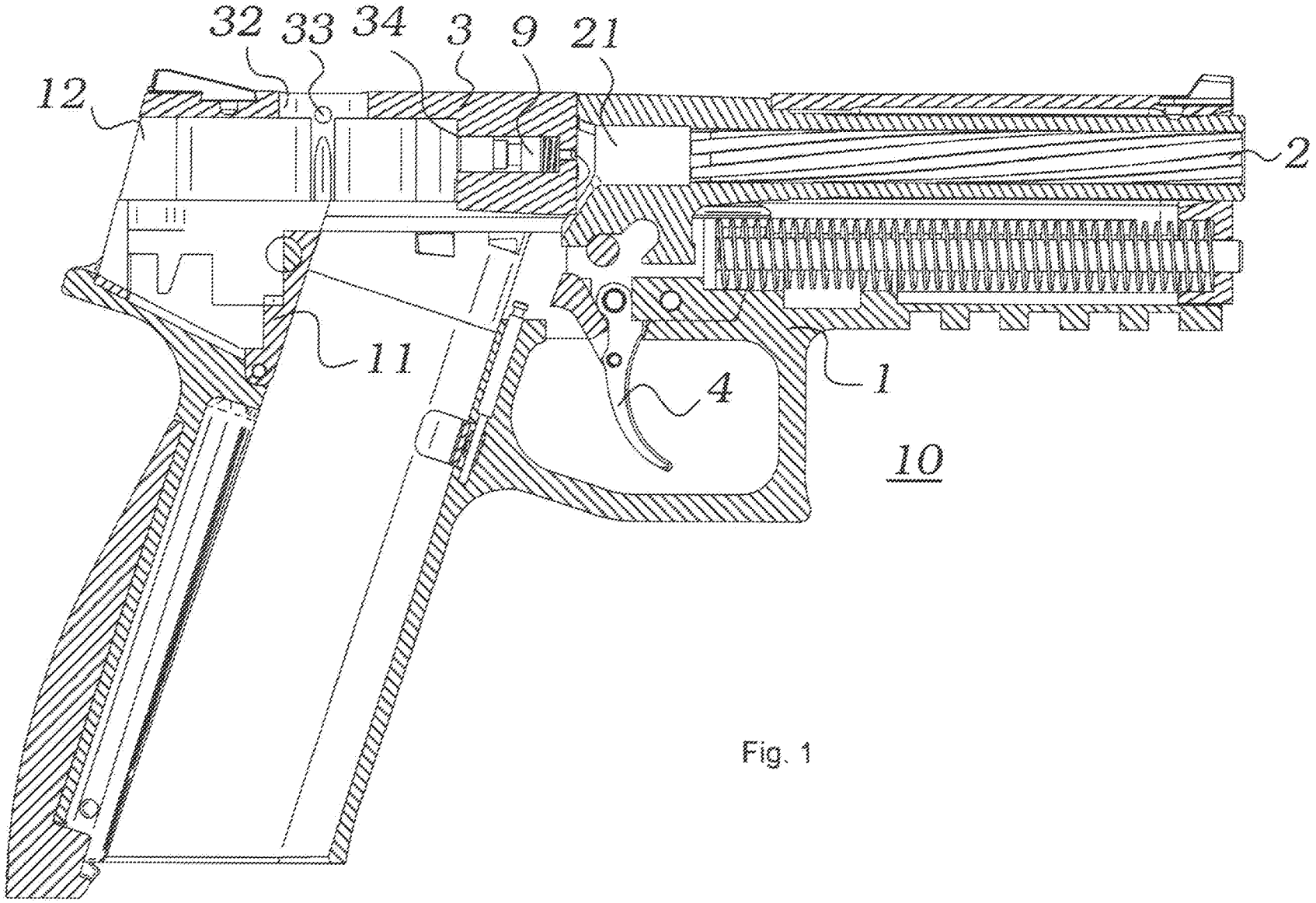
FIG. 1 shows the sectional elevation view of the handgun made according to the invention without the frame and slide insets.

FIG. 1 shows the sectional elevation view of a handgun 10 according to the invention having main parts constituted by frame 1, barrel 2, slide 3 and trigger. The parts which are not specially mentioned in the present description have design and function as usual in conventional handguns. It is not an objective of the present description to illustrate and describe the details of handguns known for decades or even for centuries, therefore the respective parts will be mentioned only it the context as required for understanding the design and operation of the present invention.

At the rear end of the barrel 2 for receiving a cartridge (not shown) in the drawing a cylindrical cartridge receiving chamber 21 is provided, which is abutting a frontal face of the slide 3 in which a central bore is provided including a spring-biased firing pin 9. The firing pin 9 can move forward in axial direction guided by a surrounding bore against the spring-bias. Such a movement is triggered by a hit acting on its rear surface that activates the shot, because thereby the frontal end of the firing pin 9 hits the primer of the cartridge located in front of it.

In the slide 3 behind the rear end of the firing pin 9 a slide pocket 12 is provided has a cavity extending till the rear end of the slide 3 and the task of the slide pocket 12 is to receive a slide inset designed according to the system chosen by the user. In the upper wall of the slide 3 a rectangular opening 32 is provided and a bore 33 is made through the side wall of the slide 3.

At the upper rear end of the frame 1 a frame pocket 11 is provided which has a task similar to that of the slide pocket 12 because this can receive a frame inset made according to the chosen system.

Depending on the type of the member inserted in the frame pocket 11 and in the slide pocket 12 the handgun 10 will trigger the shot according to a hammer type system or a striker system when the user pulls the firing trigger 4.

Figure 3:
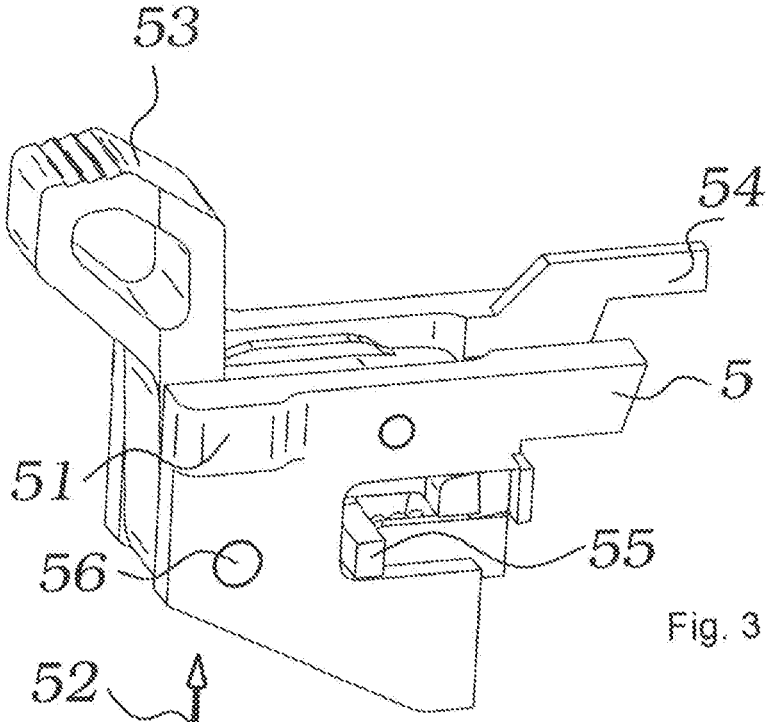
FIG. 3 shows the perspective view of the pocket that can be fitted into the frame inset in case of use in hammer system.
Figure 2:
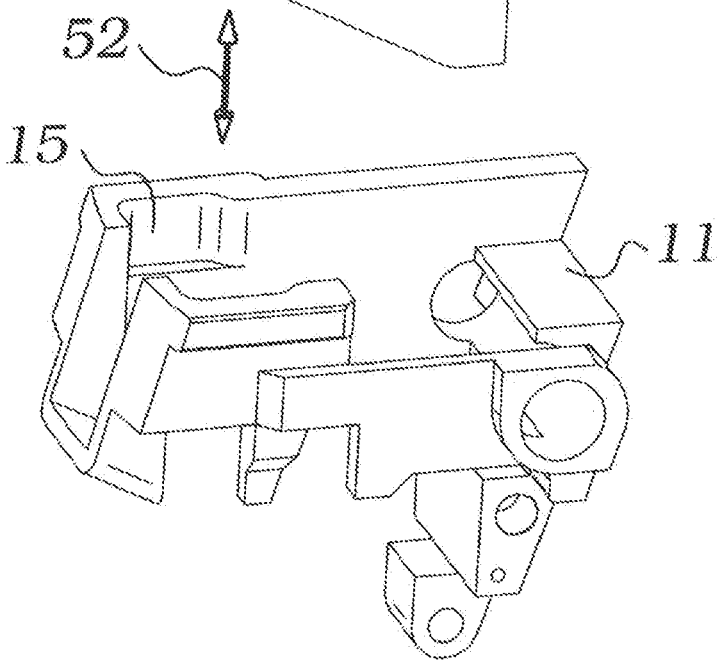
FIG. 2 shows a detail of the case in perspective view in which the pocket of the frame inset can be seen.

First the design and the operation of the hammer type system will be described. FIG. 12 shows a detail of the frame pocket 11 seen from the top and slightly from a side. On the side wall of the frame pocket 11 visible in FIG. 3 has a cavity 15 or depression which has a vertical direction that widens in lateral direction and has a rounded trapezoid shape, which is also provided in the opposite side wall of the frame pocket 11 not shown in FIG. 2. In FIG. 3 a hammer type frame inset 5 is shown in perspective view which has a pair of lateral swelling parts 51 that can be inserted with loose fit into the two lateral cavities 15, whereby the frame inset 5 can be inserted in and removed from the frame pocket 11 from above in vertical direction as shown in the double edge arrow. The main details on the hammer type frame inset 5 are: pulling head or hammer 53, positioning element 54, releasing bolt 55 and hinge 56 around which the pulling hammer 53 can be turned.

Figure 6:
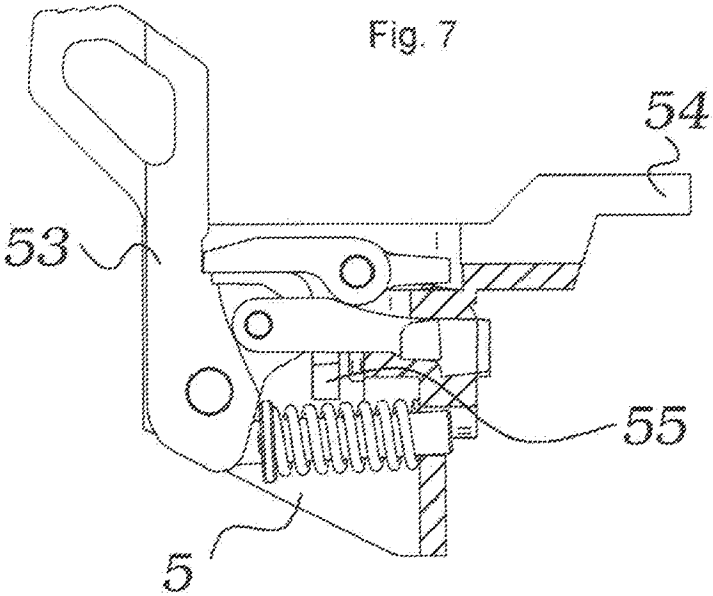
FIG. 6 shows the sectional view of the frame inset shown in FIG. 4.
Figure 5:
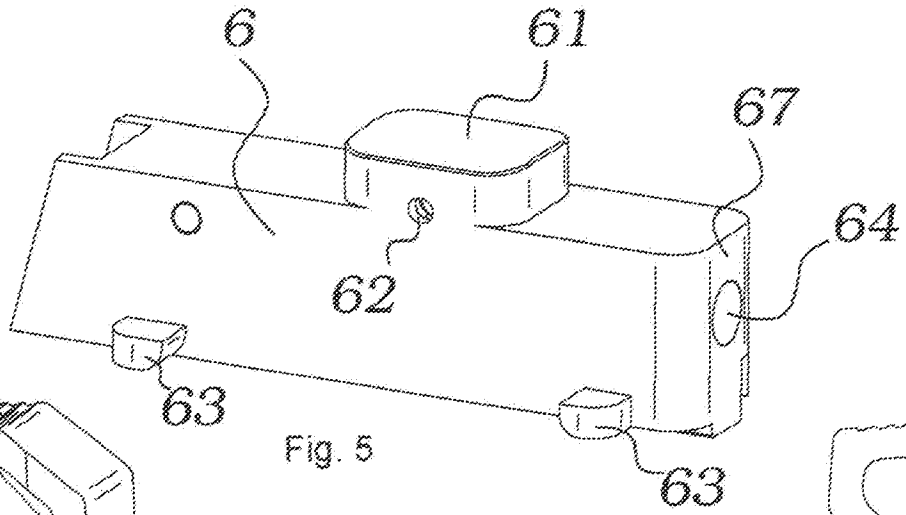
FIG. 5 shows the perspective view of the slide inset in case of hammer system.
Figure 4:
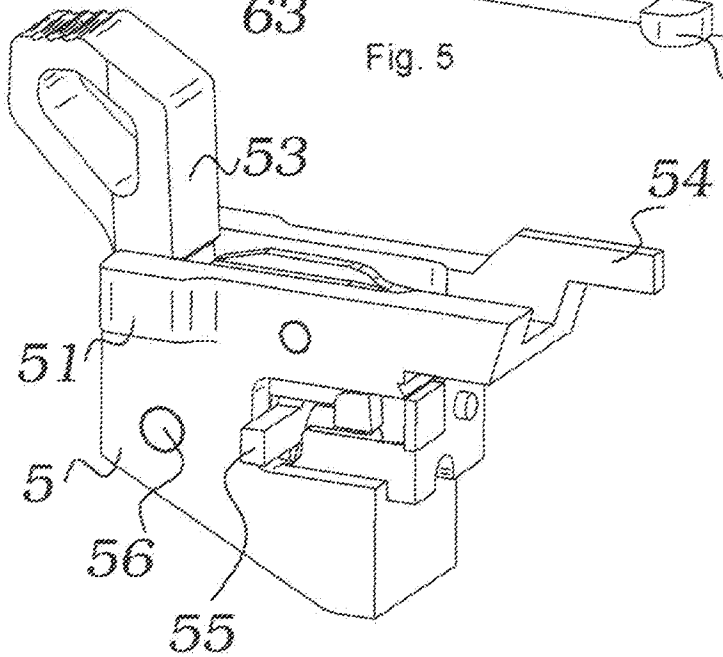
FIG. 4 is a view similar to FIG. 4 projected from a different position.

In FIGS. 4 and 6 the perspective view the hammer type frame inset 5 is shown as projected from a different direction than in FIG. 3 and in sectional view, respectively. Above them a hammer-type slide inset 6 is shown in FIGS. 5 and 7 also in perspective and sectional views.

The hammer-type slide inset 6 has a substantially oblong shape, and from its central upper portion an upwardly extending part 61 is swelling out that fits in the opening 32 provided in the upper portion of the slide 3. In this extending part 61 a transversal bore 62 is provided that is positioned in the extension of the bore 33 when the slide inset 6 has been inserted into the slide 3 and enables by means of a telescopic sliding pin the insertion and removal of the slide inset 6 into or from the slide 3. The position of the slide inset 6 is secured by laterally extending claws 63 at the bottom thereof, whereas the slide 3 comprises corresponding pockets for the claws 63 (not shown in the drawing).

Figure 7:
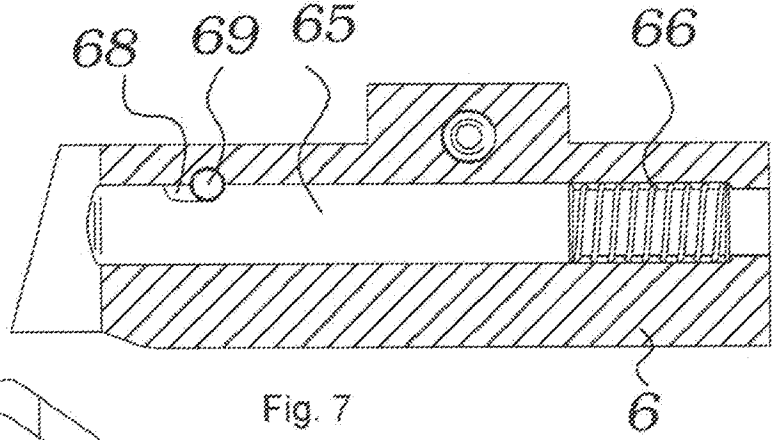
FIG. 7 shows the sectional view of the slide inset shown in FIG. 5.

In the sectional view of FIG. 7 it can be seen that an axial bore 64 is provided through the hammer-type slide inset 6, in which a hit-forwarding pin 65 and a spring 66 are provided, wherein the spring 66 provides a slight rearward bias to the pin 65. In the zone of the spring 66 the pin 65 has a decreased diameter for ensuring place, and the so formed rear step provides a rear support for the spring 66. In the frontal portion the bore 64 has a slight step for abutting the frontal end of the spring 66. FIGS. 5 and 7 show the slide inset 6 in initial basic position when the pin 65 is in rearward position under the bias of the spring 66 and its frontal face does not extend out from the front fact of the slide inset 6. The axes of the bore 64 and of the pin 65 guided therein in axial displacement fall in the extension of the axis of the firing pin 9 in the slide, and the frontal face 67 of the slide member 6 abuts a shoulder 34 defining the rear end of the firing pin 9 (FIG. 1). In the sectional view of FIG. 7 a short axial depression 68 can be seen provided on the top of the pin 65, in which a transversal shaft 69 is inserted that limits the axial displacement of the pin 65. In FIG. 7 the bias of the spring 66 keeps the pin 65 in its rearmost position, when its frontal face does not extend of from the frontal face 67 of the slide inset 6, but its rear end extends out slightly from the body of the slide inset 6.

The hammer-type insert shown in FIGS. 4 and 6 has a conventional internal design, of which it is only mentioned that in the drawing the pulling hammer 53 is in firing position when its firing frontal surface is vertical and at the same time this is the most forward position thereof. When inserted in the handgun 10 the firing plane of the hammer 53 abuts the central rear face of the slide inset 6 and pushes the rearward extending pin 65 in forward direction till abutment and thrusts it against the weak bias force of the spring 66, and the pin 65 pushes the firing pin 9 forward what triggers a shot.

In the sectional view of FIG. 6 the pulling hammer 53 is locked in the biased position when it is in downward position by a biasing spring and a locking assembly, and this locked state is released by a rearward movement and pressure of the releasing bolt 55.

Reference is made now to FIG. 8 which shows the perspective view of a detail of the firing assembly operating the hammer type frame inset 5. Shaft 41 journals the trigger 4 and its pulling pushes backwards a firing rod 14 in the direction of arrow 42 and acting as a single arm lever, which rearward movement takes place at the right side of the frame 1, and its rear end pushes the releasing bolt 55 present in the frame inset 5. This movement releases the locked state of the pulling hammer 53 and allows it to turn into forward direction with high force. At the end of this movement the forward face of the pulling hammer 53 pushes the rear end of the pin 65 present in the slide inset 6 in forward direction against the bias of the spring 66, and the front face of the pin pushes the firing pin 9 forward that triggers the shot.

This solution provides thereby a perfect hammer type operation whereas it makes it possible that first the slide inset 6 and then the frame inset 5 under it be removed from the slide 3 and from the frame 1 and provides space for adjusting the handgun 10 into striker mode operation.

This second mode of operation is described with reference to FIGS. 9 to 13. FIGS. 9 and 11 show frame inset 7 used in striker mode in perspective view and in section, respectively. Above them in FIGS. 10 and 12 a slide inset 8 is shown also both in perspective and sectional views.

If the frame inset 7 is compared with the frame inset 5 shown in FIGS. 4 and 6 the similarity in their outer shapes will become apparent. Swelling parts 71 provided at the side of the frame inset 7 (of which the one at the left side is covered in FIG. 9) have identical shapes and positions as the swelling parts 51 in the previous embodiment. Similarly, positioning element 74 is identical with the positioning element 54 of the previous embodiment. Therefore, the frame inset 7 can be inserted in the frame pocket 11 provided in the frame 1 for this purpose (FIG. 2) without the need of any change just as it was possible for the frame inset 5. The difference lies only in their internal designs, which in the present embodiment is constituted by a hinged multi-lever tilting assembly, which ensures that in initial or basic state a locking nose 76 takes a high (elevated) position as shown in FIG. 11 and it is coupled to a locking fork 85 provided in the slide inset 8 above it. When a backwardly directed force acts on buffer face 75 provided at the central lower zone of the hinged tilting assembly, the locking nose 76 gets tilted in downward direction and releases thereby the locking fork 85.

The outer design of the slide inset 8 used in striker mode is almost the same as that of the slide inset 6 shown in FIG. 5, a difference lies only in its rear portion because now there is no need to the U-shaped recess that receives the pulling hammer 53. To the upwardly extending part 61 shown in FIG. 5 a similar part 81 corresponds that is shown in FIG. 10, to the positioning claws 63 the corresponding elements are claws 83 and bore 82 corresponds to the bore 62.

Reference is made now to FIG. 12 in which an axial stepped bore 84 extends through the interior of the slide inset 8, in which a striking pin 80 is arranged. The bore 84 guides the striking pin 80. At the forward end of the bore 82 an buffer insert 86 is provided that supports the front part of the spring 87. The diameter of the pin 80 increases just before the buffer insert 86, whereby when the buffer insert 86 moves forward then it pulls the striking pin 80. The rear end of the spring 87 abuts a sleeve 88 inserted in the rear portion of the stepped bore 82. In the frontal portion of the sleeve 88 a second spring 89 is arranged and its forward end abuts a frontal shoulder of the sleeve 88 and its rear end is supported by the striking pin 80. The locking fork is also guided in the sleeve 88 that provides a rear support and guidance to the striking pin 80. The spring 87 is much stronger than the second spring 89.

FIG. 13 is a perspective view similar to FIG. 8 which shows the connections between the trigger 4 and the frame inset 7. When the 4 is pulled, the rear end of the firing rod 14 pushes the buffer face 75 shown in FIG. 9 in rearward direction whereby through the pivotal assembly the locking nose 76 shown in FIG. 11 will move in downward direction and releases the locking fork 85.

The way of the striker-type operation can be understood with reference to FIG. 12 and also to FIG. 13 that shows the slide inset 8 with removed case. When the slide 3 moves in backward direction after a first shot (or at the first shot when the slide is pulled back), then it moves also the slide inset 8 with it with respect to the position shown in FIGS. 12 and 13. Then the locking fork 85 arrives behind the locking nose 76 (shown in FIG. 11) and tilts it against a spring (not shown) in downward direction and moves behind over its path and then the spring will raise the locking nose 76 again in its original locked position. The slide 3 will be moved forward by a strong recoil spring arranged in the handgun 10 (not shown) into its initial position. During this forward movement however the locking nose 76 will engage the bottom of the locking fork 85, and the abutment member 86 together with the striking pin 80 within it will remain in the locked rearward position with respect to the case of the slide inset 8. This position will be maintained till the next pulling of the trigger 4, and when this is pulled, the locking nose 76 will release the locking fork 85, and the previously biased spring 87 will move forward with high speed and will move the striking pin 80 with it. The spring 87 will be stopped by the buffer insert 86 when it abuts the front shoulder of the stepped bore 84, but the accelerated striking pin 80 therein will continue its movement under the effect of its impulse and is the firing pin 9 shown in FIG. 1 that releases firing by hitting the primer of the cartridge. Thereafter the slide 3 moves against backward and the locking fork 85 will become locked again and the spring 89 pulls the striking pin 80 into the rear position shown in the drawing, whereby the handgun 10 gets again into a ready to firing state.

The invention claimed is:

1. Double firing mode semi-automatic handgun, comprising a frame (1), a barrel (2), a spring biased slide (3), a trigger (4) and a firing assembly with a firing rod (14) operated by the trigger (4), comprising a frame pocket (11) provided in a rear part of the frame (1) and being open from above, in which in hammer mode an associated frame inset (5) and in striker mode an associated other frame inset (7) can be inserted, and the rear part of the slide (3) comprises a slide pocket (12) in which in hammer mode an associated slide inset (6) and in striker mode an associated other slide inset (8) can be inserted, and in front of the connection site of the slide pocket (12) and behind the barrel (2) a firing pin (9) is arranged extending to a cartridge receiving chamber (21), and in both firing modes the frame insets (5 or 7) and the slide insets (6 or 8) cooperate and by means of the rearward motion of the firing rod (14) a surface is pushed on the frame inset (5 or 7), namely in hammer mode a surface of a releasing bolt (55) and in striker mode a buffer face (75), and this pushing movement is transformed into an axial hit on the firing pin (9) by a spring bias or by the release of a lock.

2. The handgun as claimed in claim 1, wherein in hammer mode in the rear part of the frame inset (5) a hinge (56) is provided around which a pulling hammer (53) can be turned, and locked biasing elements and a locking mechanism being coupled to the pulling hammer (53) that can be released by a releasing bolt (55), and a bore (64) extends through the slide inset (6) in which a pin (65) is guided for limited axial movement that has a rear end extending out from a rear face of the slide inset (6) which is hit by the upper face of the pulling hammer (53) when the locking gets released, and then the other end of the pin (65) extends out of the front of the slide inset (6) and hits and pushes the rear end face of the firing pin (9).

3. The handgun as claimed in claim 1, wherein in striker mode in the other frame inset (7) a locking nose (76) is provided that extends out till the bottom of the other slide inset (8), and the locking nose (76) is connected with said buffer face (75) by means of a hinged multi-lever assembly that is moved in downward direction when said buffer face (75) is pushed backwards, and in the other slide inset (8) a stepped axial bore (4) is provided in which a striking pin (80) is guided, at the front part of the stepped bore (84) a buffer insert (86) is provided which abuts the forward end of a spring (87) surrounding the striking pin (80), and the striking pin (80) has a frontal shoulder which supports the buffer insert (86), and in the rear part of the stepped bore (84) a sleeve (88) is arranged, and the spring (87) contacts the front end of the sleeve (88), and around the rear end part of the striking pin (80) an upper part of a locking fork (85) is arranged, and between a front face of the locking fork (85) and a shoulder of the sleeve (88) a second spring (89) weaker than said spring (87) is arranged, and when the slide (3) moves following a rearward movement in forward direction the locking fork (85) gets locked by the locking nose (76) arranged in the frame inset (7), whereby the spring (87) gets biased in this locked position.

4. The handgun as claimed in claim 1, wherein the frame inset (5 and 7) comprises at its upper part lateral swelling parts (51 or 71) and in the frame pocket (11) opposite to said swelling parts (51 or 71) conforming cavities (15) are arranged in which said swelling parts (51 or 71) can be fitted.

5. The handgun as claimed in claim 1, wherein in the central upper zone of the slide insets (6 or 8) an upwardly extending part (61 or 81) is provided comprising a transversal bore (62 or 82), and the slide (3) comprises a corresponding opening (32) and a transversal bore (33) by which the slide member (6 or 8) can be fixed in the slide (3).

* * * * *